US006205936B1

(12) United States Patent
Nelson et al.

(10) Patent No.: US 6,205,936 B1
(45) Date of Patent: Mar. 27, 2001

(54) FABRIC DECORATABLE FURNITURE SYSTEM

(75) Inventors: Linda Mae Nelson; Judith A. Van Essen Kenyon; Patricia A Lloyd, all of Scottsdale, AZ (US)

(73) Assignee: Create It Decor, Inc., Scottsdale, AZ (US)

( * ) Notice: Subject to any disclaimer, the term of this patent is extended or adjusted under 35 U.S.C. 154(b) by 0 days.

(21) Appl. No.: 09/376,647

(22) Filed: Aug. 18, 1999

(51) Int. Cl.[7] ..... A47B 13/02; A47B 13/08

(52) U.S. Cl. ..... 108/157.1; 108/90; 108/157.16; 108/157.18; 108/157.15; 248/95; 248/99; 248/101; 297/440.11; 297/440.13

(58) Field of Search ..... 297/440.13, 440.11, 297/218.4, 228.11, 226; 108/90, 157.1, 157.15, 157.18, 157.16; 150/158; 403/291; 248/95, 99, 101, 230.8, 345.1

(56) References Cited

U.S. PATENT DOCUMENTS

| | | | | |
|---|---|---|---|---|
| 565,435 | * | 8/1896 | Crater | 108/157.1 |
| 1,097,701 | * | 5/1914 | Yount | 248/99 X |
| 1,219,790 | * | 3/1917 | Taylor | 108/90 |
| 1,879,087 | * | 9/1932 | Chomik | 108/157.16 |
| 1,940,117 | * | 12/1933 | Carpos | 108/157.18 |
| 3,230,909 | * | 1/1966 | Watson | 297/440.13 X |
| 3,893,649 | * | 7/1975 | Cornell et al. | 248/99 |
| 3,927,445 | * | 12/1975 | Pavlish | 248/95 X |
| 4,089,560 | * | 5/1978 | De Mattos | 297/440.11 |
| 4,124,185 | * | 11/1978 | Preisinger | 248/101 X |
| 4,287,701 | * | 9/1981 | Washington | 248/99 X |
| 4,338,979 | * | 7/1982 | Dow | 248/101 X |
| 4,482,116 | * | 11/1984 | Vadnais | 248/99 |
| 4,760,802 | * | 8/1988 | Leong | 108/157.16 |
| 4,805,858 | * | 2/1989 | Taylor | 248/99 |
| 4,899,967 | * | 2/1990 | Johnson | 248/99 X |
| 4,905,612 | * | 3/1990 | Apissomian | 108/157.15 |
| 5,082,219 | * | 1/1992 | Blair | 248/99 |
| 5,339,748 | * | 8/1994 | Bilotti | 108/90 |
| 5,353,716 | * | 10/1994 | Wilbert | 108/157.1 X |
| 5,518,212 | * | 5/1996 | Sigler | 248/101 |
| 5,740,939 | * | 4/1998 | Muldner et al. | 248/101 X |

* cited by examiner

*Primary Examiner*—Peter M. Cuomo
*Assistant Examiner*—Rodney B. White
(74) *Attorney, Agent, or Firm*—The Halvorson Law Firm

(57) ABSTRACT

Presented herein is lightweight furniture that is designed to be decorated with cloth or fabric. The decoratable furniture provides for removable ultimate fabric decoration of the furniture. The furniture has a body that attaches to a leg arrangement. The body has at least one flat surface, a top surface, and an edge structure located about the perimeter of the top surface. The edge structure has a cloth receiving channel into which cloth, or fabric, may be inserted and removably, yet securely, held in place. Thus, the fabric may be easily removed for cleaning or changing.

18 Claims, 7 Drawing Sheets

FABRIC DECORATABLE FURNITURE SYSTEM

FIELD OF THE INVENTION

The present invention relates to the field of decoratable furniture. More specifically, the present invention relates to lightweight furniture that is designed to be decorated with cloth or fabric. The present invention relates generally to decoratable furniture and, more particularly, to a new and improved furniture design that provides for removable ultimate fabric decoration of the furniture.

BACKGROUND OF THE INVENTION

Traditional furniture designs include heavy and expensive wood or metal frames to provide stability and rigidity to the furniture shape. These traditional designs are durable but generally difficult to move and come in a limited fabric selection. Moreover, these traditional designs are expensive to clean, since either an outside cleaning crew must be retained or a bulky and difficult to use cleaning machine must be rented.

Light weight and generally inexpensive furniture is known in the related art, but generally has used either a solid core of compressed particle board or of foamed polyurethane or polyethylene. Either a permanent fabric cover is pre-attached to the furniture or a portion of cloth is merely thrown over the furniture (as a cover). While this functions as furniture, there is no capability to customize or enhance the decorative look of the furniture.

The present invention is an innovation in the furniture art that allows the benefits of a light weight core and further provides for a capability to customize or enhance the decorative look of the furniture.

SUMMARY OF THE INVENTION

It is an object of the present invention to provide a device and method that allow for one to easily and removably decorate a piece of furniture.

It is another object of the present invention to provide a piece of furniture that has a body and an attached leg arrangement. The body further having at least one flat surface, the top surface, and an edge structure located about the perimeter of the top surface.

It is a further object of the present invention to provide a piece of furniture with an edge structure that has a channel bottom and two channel side walls.

It is a yet another object of the present invention to provide a piece of furniture with an edge structure that has two channel side walls that are substantially parallel and meet the channel bottom to form an angular connection.

It is a still yet another object of the present invention to provide a piece of furniture with an edge structure that has two channel side walls that are substantially parallel and substantially continuously merge into the channel sides walls to form a smooth connection.

It is a still yet a further object of the present invention to provide a piece of furniture with an edge structure that has two channel side walls that converge away from the channel bottom and meet the channel bottom to form an angular connection.

It is an even further object of the present invention to provide a piece of furniture with an edge structure that has two channel side walls that converge away from the channel bottom and substantially continuously merge into the channel sides walls to form a smooth connection.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. § 112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF THE PREFERRED EMBODIMENTS

The present invention is a device and method for the decoration of furniture, such as tables, benches, and the like.

Figure 1:
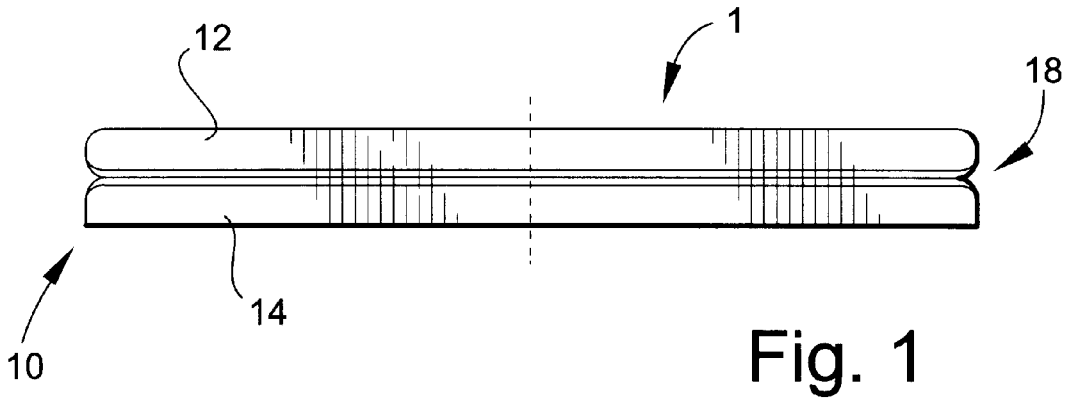
FIG. 1 is a side view of the body of the present invention.
Figure 2:
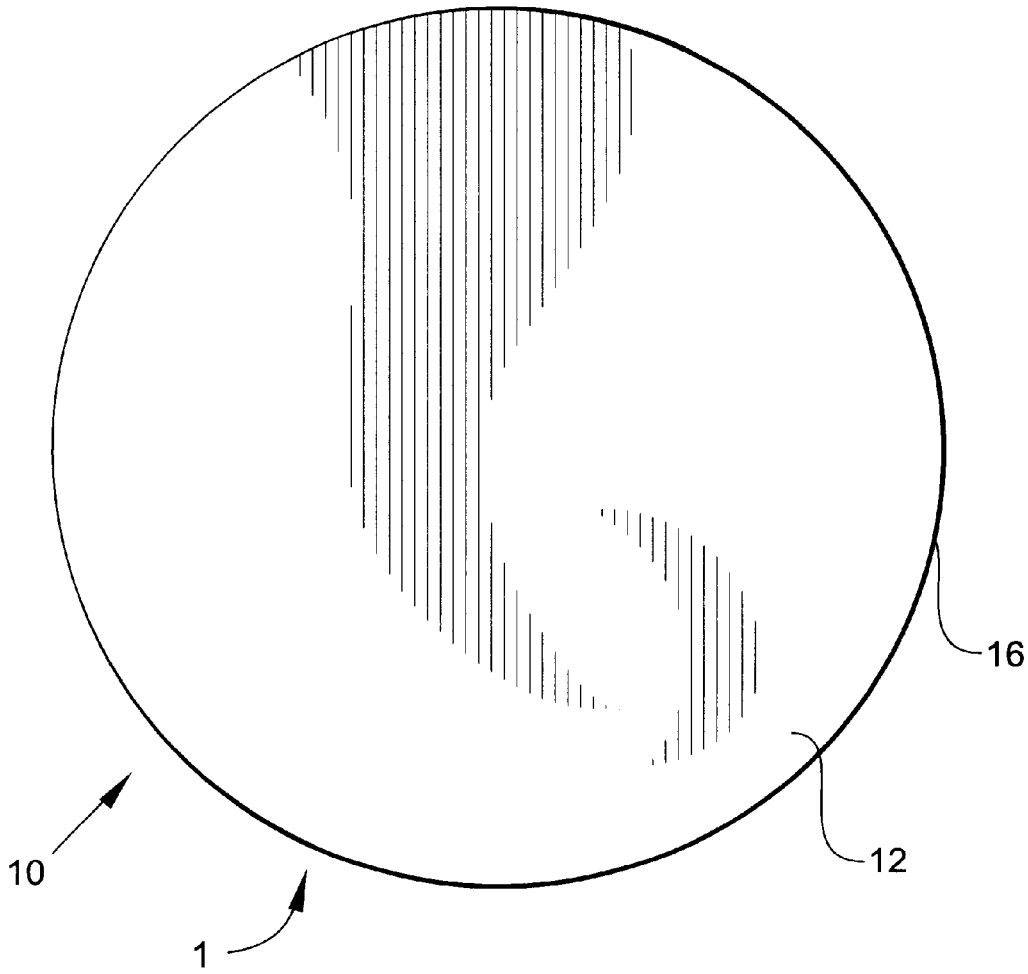
FIG. 2 is a top view of the body of the present invention.
Figure 3:
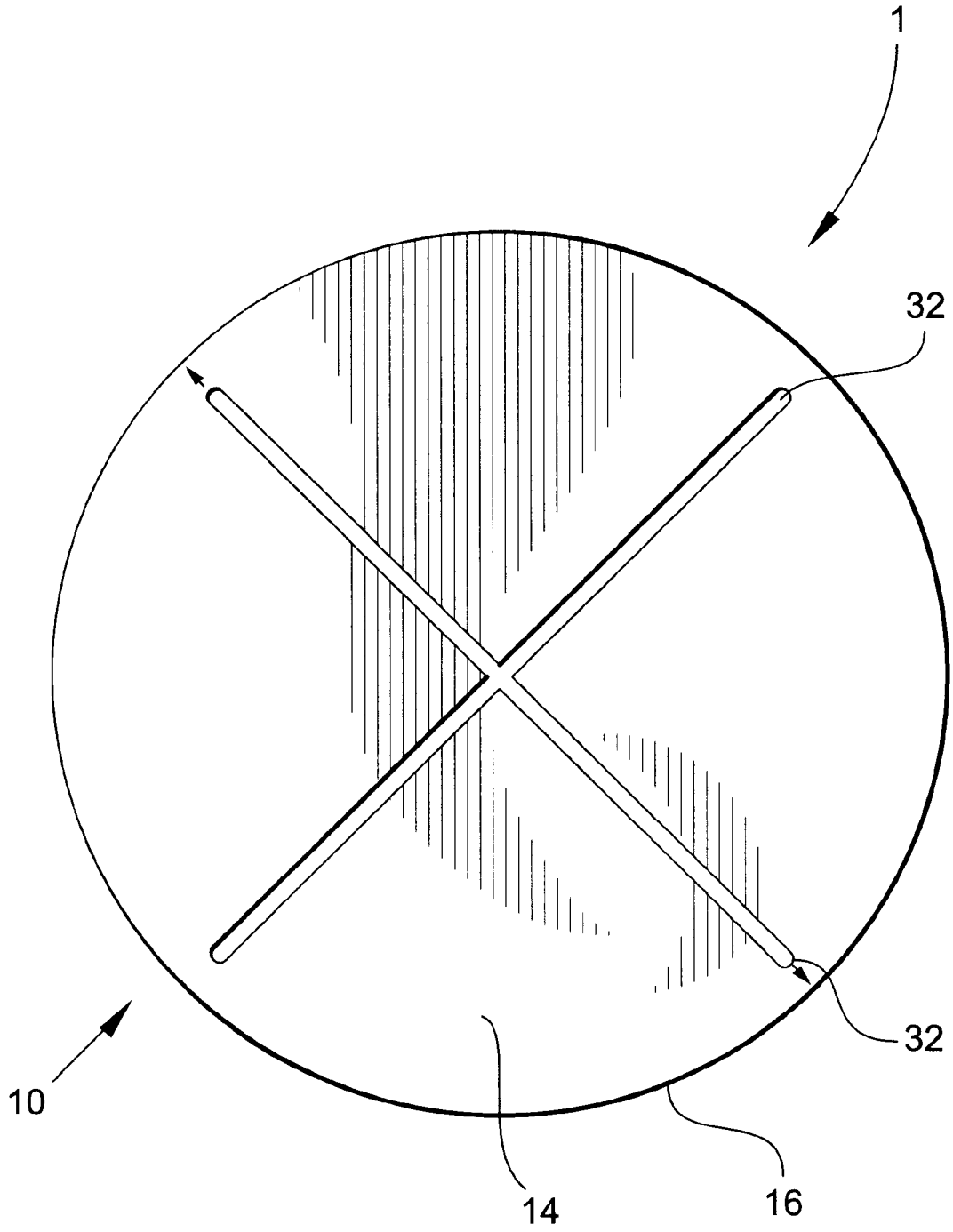
FIG. 3 is a bottom view of the body of the present invention.
Figure 4:
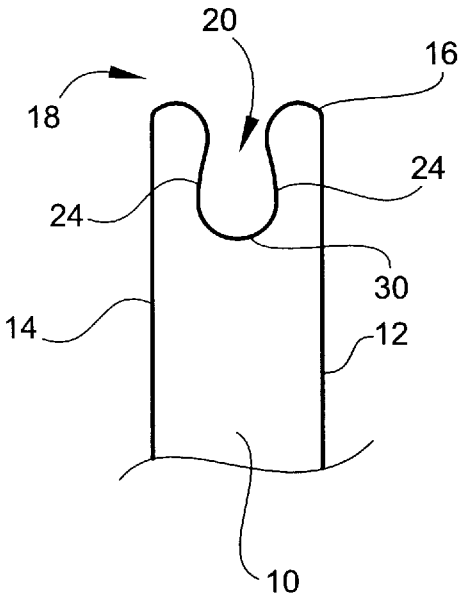
FIG. 4 is one illustration of the structural channel according to the present invention.
Figure 5:
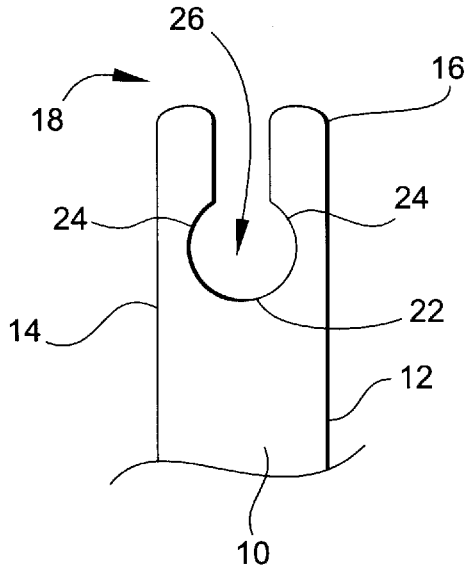
FIG. 5 is an illustration of an alternate embodiment of the structural channel according to the present invention.
Figure 6:
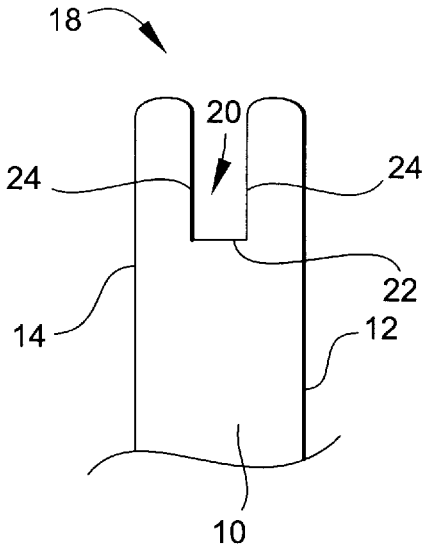
FIG. 6 is an illustration of another alternate embodiment of the structural channel according to the present invention.
Figure 7:
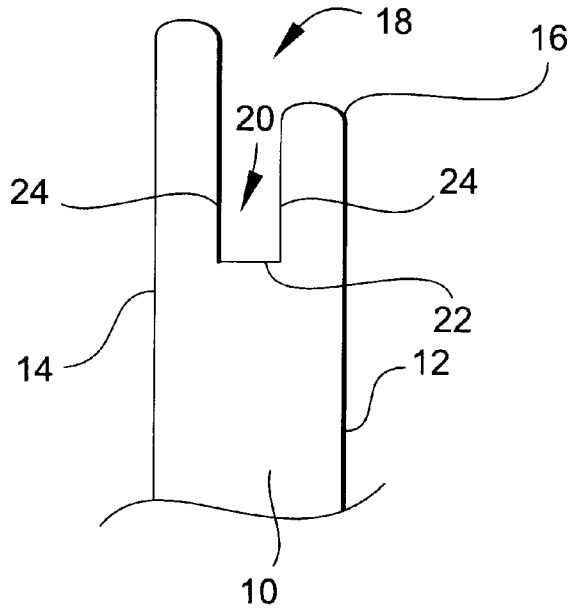
FIG. 7 is one illustration of yet another alternate embodiment of the structural channel according to the present invention.
Figure 8:
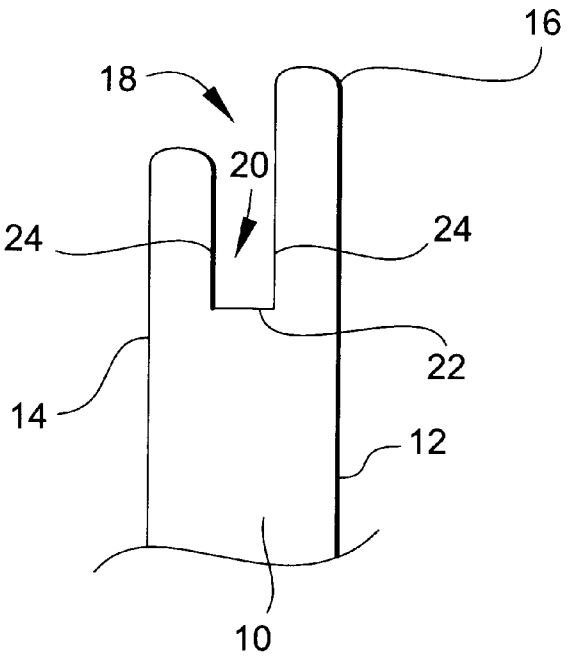
FIG. 8 is one illustration of still yet another alternate embodiment of the structural channel according to the present invention.
Figure 9:
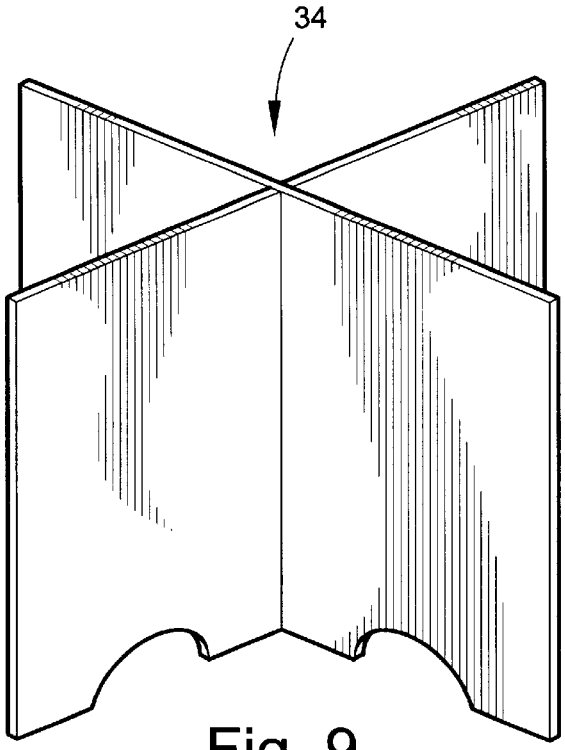
FIG. 9 shows an example table leg arrangement made from two parts.
Figure 10:
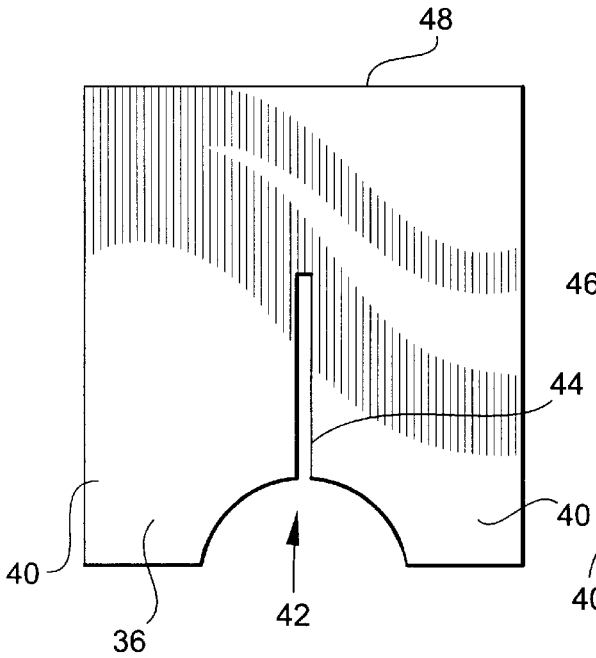
FIG. 10 shows one of the two parts for the two part table leg arrangement illustrated in FIG. 9.
Figure 11:
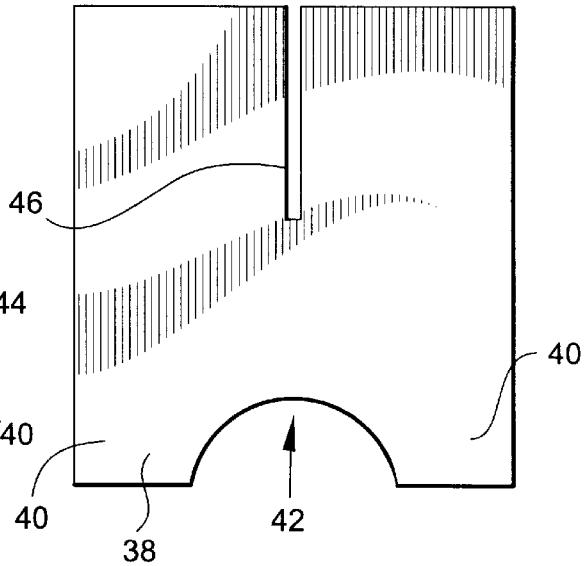
FIG. 11 shows the remaining part for the two part table leg arrangement illustrated in FIG. 9.
Figure 12:
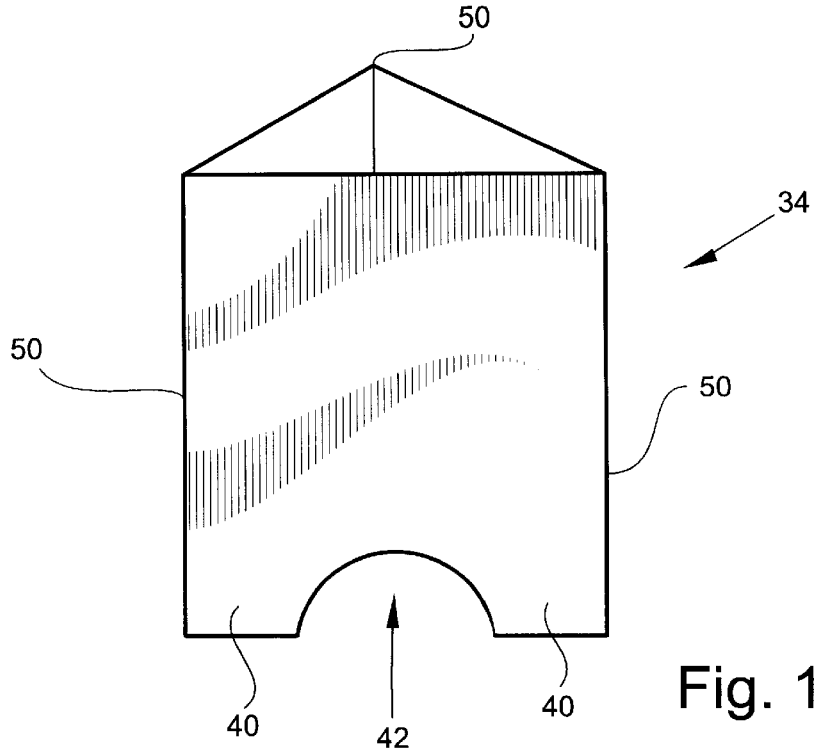
FIG. 12 show another embodiment for the table leg arrangement.
Figure 13:
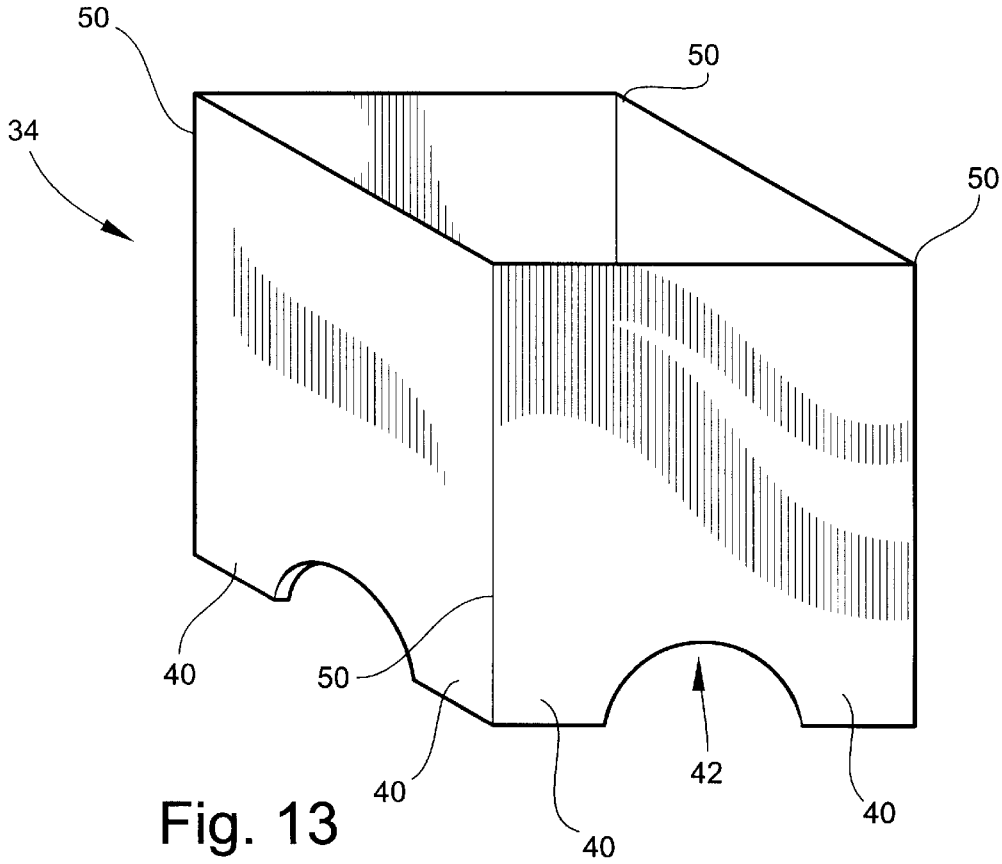
FIG. 13 shows yet another embodiment for the table leg arrangement.
Figure 14:
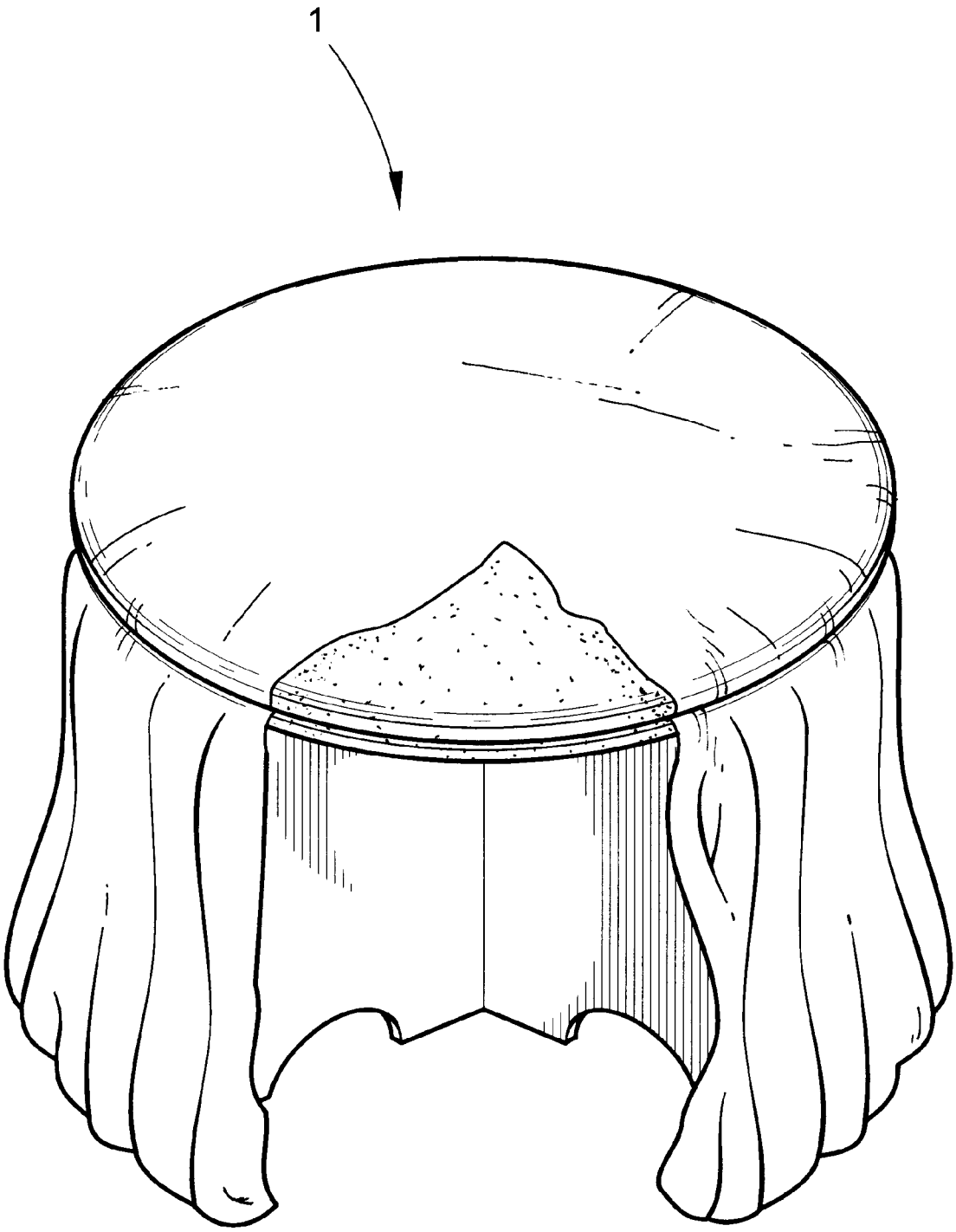
FIG. 14 is a perspective, with a partial cut-away of the fabric, of the furniture according to the present invention.

Referring to FIGS. 1, 2, and 3, the present invention comprises a piece of furniture 1 with a body 10 that has at least one substantially flat surface. It is preferred that the body 10 have at least two substantially flat surfaces, 12 and 14, each being substantially parallel to the other thereby forming what will be known as, for purposes of this application, a "top surface" 12 and a "bottom" surface 14 (FIGS. 2 and 3). Located at the perimeter 16 of the top and bottom surfaces, 12 and 14, and clearly illustrated in FIG. 1, is an edge structure 18 that extends between the top surface 12 to the bottom surface 14.

The form of the edge structure 18 is critical to the present invention. Referring to FIGS. 4 through 8, located in the edge structure 18, and completely running the entire perimeter 16 of the body 10, is a fabric receiving channel 20. This fabric receiving channel 20 is generally wide enough to receive and securely, but removably, hold at least one layer of fabric material. The shape of the channel 20 is generally U-shaped with a channel bottom 22 and two channel side walls 24, FIG. 4. Alternately, the channel may have a key-hole shape 26, FIG. 5, or other like shapes sufficient enough to removeably secure at least one layer of fabric material.

It is preferred that the channel side walls 24 be either substantially parallel or slightly convergent. This is to provide a structure that can efficiently use friction and/or pressure to securely, but removeably, hold fabric materials that have been inserted within the channel 20. A channel 20 with diverging side walls 24, such as a V-shaped channel, falls within the scope of the present invention but is not preferred since the divergence of the side walls 24 offers little structure that functions to hold and retain inserted fabric materials.

The channel bottom 22 may be substantially flat, thereby forming a corner 28, or angular connection, with the channel side walls 24. Alternately, the channel bottom 22 may have a concave shape 30 and continuously merges into the channel side walls 24 without forming an angular corner.

Inset in the bottom surface 14 of the body 10 are leg arrangement receiving channels, generally 32. These leg arrangement receiving channels are capable of receiving a separate leg arrangement, generally 34. While it is possible that the leg arrangement 34 be formed integrally with the body 10 and still fall within the scope of the present invention, it is preferred for manufacturing and shipping reasons that the two be separate pieces.

The leg arrangements 34 may be formed in a variety of different ways, as illustrated in FIGS. 9 through 13. The leg arrangement 34 may be formed in two pieces 36 and 38 that interconnect orthogonally to form a generally X-shaped structure. Each of the two pieces, 36 and 38, have feet 40 separated by a curved cut out 42. Further, piece 36 has a slot 44 that extends from a portion of the curved cut out 42 to about the center of the piece; piece 38 has a slot 46 that extends from a top edge 48 of the piece 38 to about the center of the piece 38. Thus, the two pieces 36 and 38 can be assembled by crossing the pieces, with piece 36 above piece 38; and matching the two slots 44 and 46; and sliding piece 36 down onto piece 38.

Alternately, the leg arrangement 34 may be formed in a trigonal structure by connecting at opposite ends respectively, generally 50, three pieces with two feet 40 separated by a curved cut out 42 to form an single continuous leg arrangement 34. Additionally, the leg arrangement 34 may be formed in a generally square, or rectangular, structure by connecting at opposite ends 50 respectively, four pieces with two feet 40 separated by a curved cut out 42 connected at opposite ends to form a single continuous leg arrangement 34.

The leg arrangements 34 once assembled are then inserted into the leg arrangement receiving channels 32 located on the bottom surface 14 of the body 10. It should be recognized that the above described structures may be easily modified to form benches, stools, chairs, and other like pieces of furniture 1.

Once the piece of furniture 1 has been assembled, it is ready for decoration. In decorating the piece of furniture 1, cloth, or fabric, of a desirable pattern and color are selected. Preferably two pieces are created, a first cloth piece that is sized slightly larger than the top surface 12 of the body 10. The first cloth piece should be large enough that all of the edges hang down past the edge of the top surface 12 and are capable of being inserted, and indeed are inserted into the receiving channel 20. A second cloth piece, generally rectangular in shape, is cut and is used to form a "skirt" by inserting a top edge of the second cloth piece into the receiving channel 20. The second cloth piece may be gathered to form pleats and the like, however the user desires. It should be recognized that a single piece of fabric may be used, with a portion of the middle of the fabric inserted into the receiving channel 20, to decorate the piece of furniture 1 and still fall within the scope of the present invention.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A piece of furniture comprising:

a) a body having at least one flat surface with an edge structure located about a periphery of the at least one flat surface, said edge structure further having a fabric receiving channel that extends continuously about the periphery of the at least one flat surface, said body further having a bottom surface; and b) a leg arrangement attached to the bottom surface.

2. The piece of furniture as in claim 1 wherein the fabric receiving channel further has a channel bottom and two channel side walls.

3. The piece of furniture as in claim 2 wherein the two channel side walls are substantially parallel and meet the channel bottom to form an angular connection.

4. The piece of furniture as in claim 2 wherein the two channel side walls are substantially parallel and substantially continuously merge into the channel bottom to form a smooth connection.

5. The piece of furniture as in claim 2 wherein the two channel side walls converge away from the channel bottom and meet the channel bottom to form an angular connection.

6. The piece of furniture as in claim 2 wherein the two channel side walls converge away from the channel bottom and substantially continuously merge into the channel bottom to form a smooth connection.

7. A piece of furniture comprising:

a) a body having at least one flat surface with an edge structure located about a periphery of the at least one flat surface, said edge structure further having a fabric receiving channel that extends continuously about the periphery of the at least one flat surface, said body further having a bottom surface;

b) a leg arrangement attached to the bottom surface; and c) at least one piece of fabric that is inserted into the fabric receiving channel, thereby decorating the piece of furniture.

8. The piece of furniture as in claim 7 wherein the fabric receiving channel further has a channel bottom and two channel side walls.

9. The piece of furniture as in claim 8 wherein the two channel side walls are substantially parallel and meet the channel bottom to form an angular connection.

10. The piece of furniture as in claim 8 wherein the two channel side walls are substantially parallel and substantially continuously merge into the channel bottom to form a smooth connection.

11. The piece of furniture as in claim 8 wherein the two channel side walls converge away from the channel bottom and meet the channel bottom to form an angular connection.

12. The piece of furniture as in claim 8 wherein the two channel side walls converge away from the channel bottom and substantially continuously merge into the channel bottom to form a smooth connection.

13. A piece of furniture comprising:

a) a body having at least one flat surface with an edge structure located about a periphery of the at least one flat surface, said edge structure further having a fabric receiving channel that extends continuously about the periphery of the at least one flat surface, said body further having a bottom surface;

b) a leg arrangement attached to the bottom surface; and c) at least one piece of fabric in combination with the piece of furniture, whereby said at least one piece of fabric may be inserted into the fabric receiving channel thus decorating the piece of furniture.

14. The piece of furniture as in claim 13 wherein the fabric receiving channel further has a channel bottom and two channel side walls.

15. The piece of furniture as in claim 14 wherein the two channel side walls are substantially parallel and meet the channel bottom to form an angular connection.

16. The piece of furniture as in claim 14 wherein the two channel side walls are substantially parallel and substantially continuously merge into the channel bottom to form a smooth connection.

17. The piece of furniture as in claim 14 wherein the two channel side walls converge away from the channel bottom and meet the channel bottom to form an angular connection.

18. The piece of furniture as in claim 14 wherein the two channel side walls converge away from the channel bottom and substantially continuously merge into the channel bottom to form a smooth connection.

* * * * *